US012577858B1

(12) United States Patent
McLeary et al.

(10) Patent No.: US 12,577,858 B1
(45) Date of Patent: Mar. 17, 2026

(54) COMPLIANT SCREEN WITH FLOW RESTRICTIVE PORTIONS TO REDUCE CROSS FLOW OF WELLBORE FLUIDS

(71) Applicant: Halliburton Energy Services, Inc., Houston, TX (US)

(72) Inventors: Gordon McLeary, Carrollton, TX (US); Ryan M. Novelen, Carrollton, TX (US); Stephen Michael Greci, Carrollton, TX (US); David Symon Grant, Aberdeen (GB); Jalpan Piyush Dave, Singapore (SG); Scott Elliott Wallace, Aberdeen (GB); Andrew David James Cameron, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/889,926

(22) Filed: Sep. 19, 2024

(51) Int. Cl.
*E21B 43/10* (2006.01)
*E21B 43/08* (2006.01)

(52) U.S. Cl.
CPC ..... *E21B 43/108* (2013.01); *E21B 43/084* (2013.01)

(58) Field of Classification Search
CPC ..... E21B 43/108; E21B 43/084
See application file for complete search history.

(56) References Cited

U.S. PATENT DOCUMENTS 5,310,000 A 5/1994 Arterbury et al.
5,849,188 A * 12/1998 Voll ..... E21B 43/084 29/896.6
6,722,443 B1 4/2004 Metcalfe
10,400,553 B2 9/2019 Bruce et al.
2002/0084070 A1 7/2002 Voll et al.
2002/0195245 A1* 12/2002 Lauritzen ..... E21B 43/08 166/227
2003/0021922 A1* 1/2003 Bode ..... E21B 43/103 428/34.4
2004/0144535 A1* 7/2004 Kalman ..... E03B 3/16 166/278
2005/0155772 A1 7/2005 Dusterhoft et al.
(Continued)

FOREIGN PATENT DOCUMENTS

CA 3092039 C 9/2022

OTHER PUBLICATIONS

International Search Report and Written Opinion mailed Jun. 11, 2025 in PCT/US2024/049514.

*Primary Examiner* — Neel Girish Patel
(74) *Attorney, Agent, or Firm* — The Hilton Firm PLLC

(57) ABSTRACT

Compliant screens and methods of preventing crossflow through the compliant screen in a well completion. Example compliant screens have a drainage layer, a filtration layer disposed over the drainage layer, and an outer shroud disposed over the filtration layer. The filtration layer is a mesh having a lower transition portion, an upper transition portion, and a compliant portion disposed between the lower and upper portions. Flow through the lower and upper portions is reduced relative to the compliant portion. The compliant screen is activated by expanding the compliant screen such that it makes contact with an adjacent subterranean formation and a fluid is flowed through the compliant section from the subterranean formation.

20 Claims, 7 Drawing Sheets

(56) References Cited

U.S. PATENT DOCUMENTS

| | | | | |
|---|---|---|---|---|
| 2005/0279515 | A1* | 12/2005 | Cameron | E21B 43/08 166/380 |
| 2007/0215348 | A1* | 9/2007 | Corre | E21B 33/1277 166/264 |
| 2010/0163481 | A1 | 7/2010 | McGrenera et al. | |
| 2015/0204168 | A1* | 7/2015 | Greci | E21B 43/10 166/230 |
| 2016/0222767 | A1* | 8/2016 | Sladic | E21B 43/086 |
| 2016/0258256 | A1* | 9/2016 | Nguyen | E21B 34/06 |
| 2016/0326849 | A1* | 11/2016 | Bruce | E21B 43/08 |
| 2019/0234180 | A1* | 8/2019 | Frazier | E21B 34/063 |
| 2021/0238964 | A1 | 8/2021 | Greci et al. | |

* cited by examiner

COMPLIANT SCREEN WITH FLOW RESTRICTIVE PORTIONS TO REDUCE CROSS FLOW OF WELLBORE FLUIDS

TECHNICAL FIELD

The present disclosure relates generally to wellbore operations, and more particularly, to the use of a compliant screen having flow restrictive portions that reduces the cross flow of wellbore fluids across the compliant screen without restriction of flow through the compliant portion of the compliant screen.

BACKGROUND

Natural resources such as gas, oil, and water residing in a subterranean formation may be recovered via flow into a wellbore from the subterranean formation. Recovery of these resources may occur in open hole wellbores, which lack casing and cement sheathes. Production through these wellbores may be impeded by formation particulates which can enter and potentially block or damage wellbore equipment. Compliant screens may be installed over a wellbore conduit in a wellbore. The compliant screens may be used to screen out formation particulates from wellbore fluids flowed into the wellbore conduit. Additionally, the expanded compliant screens may be used to provide some support to the formation to prevent collapse into the wellbore. During some production operations, cross flow may occur in the wellbore annulus where the wellbore fluids flow through the transition portions (i.e., the inactivated portions) of the compliant screens into the wellbore annulus instead of into the wellbore conduit. Cross flow may cause erosion of the wellbore walls and the compliant screen itself, which may reduce production and efficiency in some wellbores.

The use of compliant screens may be an important part of a production operation for some wells. The present disclosure provides improved compliant screens for reducing the cross flow of wellbore fluids without restriction of flow through the compliant portion of the compliant screen.

BRIEF DESCRIPTION OF THE DRAWINGS

Illustrative examples of the present disclosure are described in detail below with reference to the attached drawing figures, which are incorporated by reference herein, and wherein.

Figure 1:
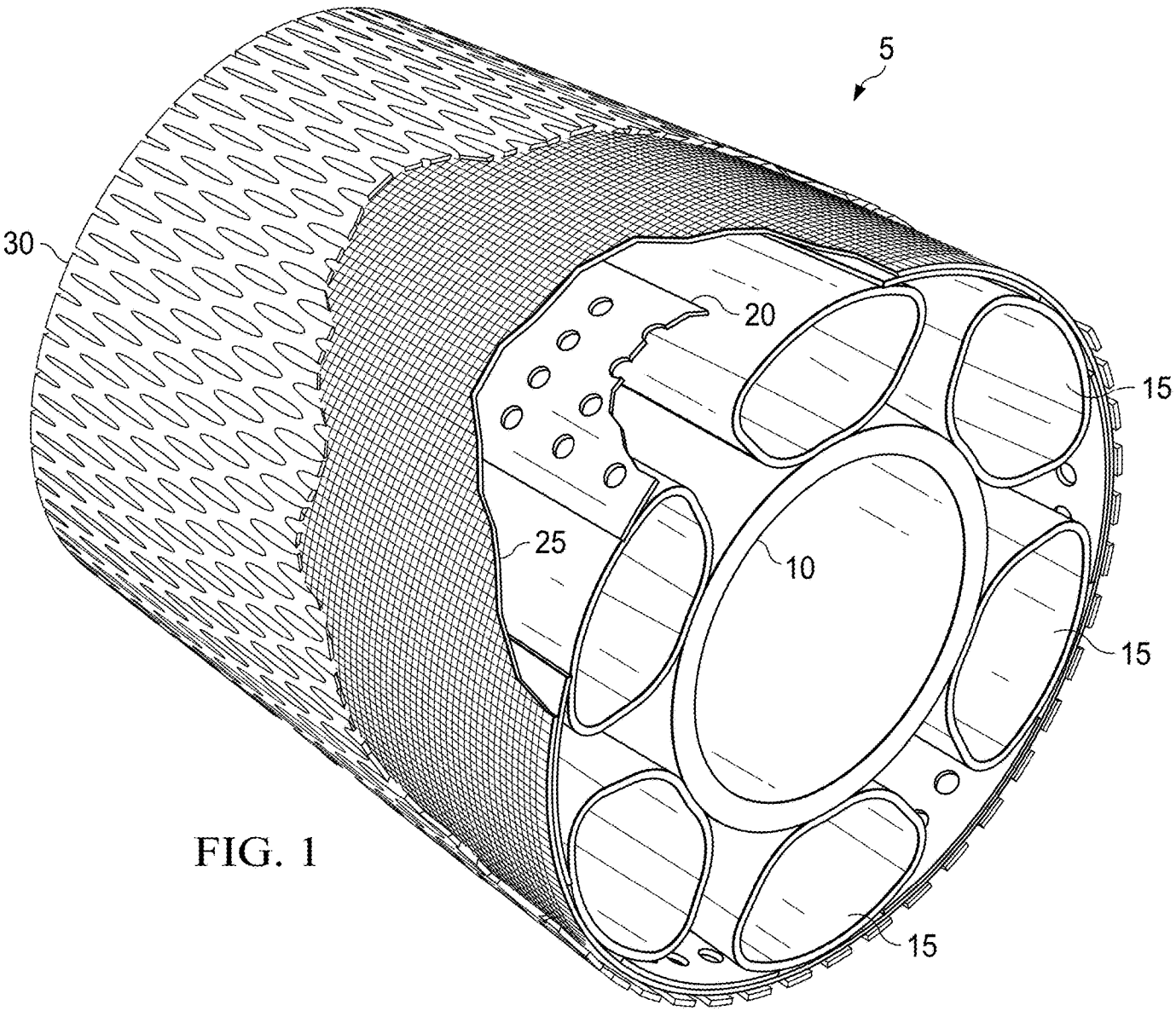
FIG. 1 is a perspective cross-section of an example compliant screen in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a compliant screen having flow restrictive portions that reduces the cross flow of wellbore fluids across the compliant screen without restriction of flow through the compliant portion of the compliant screen.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms "uphole" and "downhole" may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms "upstream" and "downstream" may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to wellbore operations, and more particularly, to the use of a compliant screen having flow restrictive portions that reduces the cross flow of wellbore fluids across the compliant screen without restriction of flow through the compliant portion of the compliant screen. Advantageously, the compliant screens reduce cross flow of wellbore fluids. A reduction in cross flow may reduce erosion of the subterranean formation. As a further advantage, the compliant screen is configured such that inflow through the compliant screen from the subterranean formation is not reduced and the wellbore fluids may be forced into the base pipe instead of bleeding into the annulus. As such, overall production efficiency may be increased and the risk of washing out a wellbore section may be reduced. As a still further advantage, the methods of reducing cross flow may not significantly impact the outer diameter of the compliant screen, thereby allowing the compliant screens to be used with standard wellbore equipment. Moreover, the restrictive portions of the compliant screens are protected by an outer shroud. The outer shroud shields the under layers of the compliant screen as it is run in hole and may avoid damage to the internal components of the compliant screen as it is installed. Additionally, it has been discovered that reducing cross flow through the compliant screen may increase the life of the compliant screen as restricting cross flow may increase the collapse rating of the compliant screen. One additional advantage is that the methods to produce the restrictive portions of the compliant screen are able to be used on traditional compliant screens. As an additional advantage, friction-reducing coatings may be used to improve deployment of the restrictive portions of the compliant screens. One other advantage is that the outer shroud may also be adapted to add restrictive portions so that it may assist in reducing cross flow through the compliant screen.

The compliant screens may be run into the wellbore by attachment to a wellbore conduit, such as production tubing. When desired for use, the compliant screens are deployed by radially expanding at least a portion of the compliant screens. The compliant screens may be expanded by pumping hydraulic fluid into activation chambers within the compliant screens to inflate the activation chambers. Alternatively, the compliant screens may be expanded by introducing specific chemicals into the wellbore to contact the compliant screens and these chemicals may induce a shape change in the compliant screens that induce expansion. Other expansion mechanisms include running an expanding tool through the wellbore conduit (e.g., using an expansion cone tool or a tool with a roller bit). In this specific example, the conduit itself is expanded which in turn causes all external components such as the compliant screen, drainage layer, etc. to expand. Once expanded, the compliant screens may then screen out formation particulates while allowing the inflow of fluids from the adjacent subterranean formation. These wellbore fluids may include hydrocarbon fluids and/or water. These fluids may flow through the compliant portion of the compliant screen into the conduit to be produced uphole at the surface. The restrictive portions of the compliant screens reduce the flow of these fluids out of the compliant screens and into the wellbore annulus.

FIG. 1 is a perspective cross-section of an example compliant screen 5. The compliant screen 5 has been deployed on a wellbore conduit 10 and may be introduced into the wellbore by being run in hole on the wellbore conduit 10. The compliant screen 5 comprises a plurality of activation chambers 15, a drainage layer 20, a filtration layer 25, and an outer shroud 30.

The wellbore conduit 10 may be any type of wellbore conduit. A specific type of wellbore conduit 10 is production tubing. The plurality of activation chambers 15 are disposed over the wellbore conduit 10. The activation chambers 15 are produced from an expandable material, such as an elastomer, and expand when a hydraulic fluid is introduced into the activation chambers 15 at sufficient pressure to expand the activation chambers. Although six activation chambers 15 are illustrated, it is to be understood that more or less activation chambers may be used as desired. Although the expansion of the compliant screen 5 is induced through the introduction of hydraulic fluid, it is to be understood that other mechanisms may be used to expand the compliant screens 5 including chemical and mechanical mechanisms. A drainage layer 20 is disposed over the activation chambers 15. The drainage layer 20 may comprise one continuous layer around the activation chambers 15 or may comprise distinct pieces spaced apart over the activation chambers 15. The drainage layer 20 allows for drainage of the influent wellbore fluid into the wellbore conduit 10 while also acting as a supporting layer for the compliant screen 5 components. A filtration layer 25 is disposed over the drainage layer 20. The filtration layer 25 is generally a mesh that is used to filter the formation particulates from the influent wellbore fluid to screen out the formation particulates from entering the wellbore conduit 10. The filtration layer 25 may comprise a single overlapping layer or multiple interwoven overlapping layers of filtration material that move over each other during the activation/expansion of the compliant screen 5. In this specific example, the filtration layer 25 comprises three portions distributed along the length of the filtration layer 25 in the axial direction. As will be illustrated below, the first portion of the filtration layer 25 is a lower transition portion. The lower transition portion is disposed downhole of the other two portions and comprises the lower terminal end of the filtration layer 25 and extends in the uphole direction for a desired length. Fluid flow through this lower transition portion is restricted. The second portion of the filtration layer 25 is the compliant portion, which is the middle portion of the filtration layer 25. The compliant portion is not restricted to fluid flow and formation fluids may flow from the subterranean formation through the compliant portion and into the wellbore conduit 10. The third portion of the filtration layer 25 is an upper transition portion. The upper transition portion is disposed uphole of the other two portions and comprises the upper terminal end of the filtration layer 25 and extends in the downhole direction for a desired length. Fluid flow through this upper transition portion is restricted.

In the example of FIG. 1, the mesh of the filtration layer 25 comprises a weave of wires having gaps between the woven wires. The woven wires may be woven in any weave pattern Examples of specific weave patterns include, but are not limited to, plain weave, twilled weave, plain Dutch weave, twilled Dutch weave, reversed plain Dutch weave, reversed twilled Dutch weave, five-heddle weave, and any combination of weave patterns.

The mesh of the lower and upper transition portions is infused with a material disposed in the gaps between the woven wires. This material closes off flow through at least a portion of the gaps which may greatly reduce cross flow through the filtration layer 25 and consequently through the compliant screen 5. As the material is only infused within the mesh of the lower and upper transition portions, flow through the compliant portion of the filtration layer 25 is not restricted. In some examples, the reduction in cross flow through the upper and lower transition portions of the filtration layer 25 may be so great that the upper and lower transition portions of the filtration layer 25 effectively seal off the compliant screen 5 from cross flow.

The infusion material may be a non-swellable material that will not swell from contact with formation and wellbore fluids. In some alternative examples, the material may utilize a swellable material. The mesh of the filtration layer 25 may be infused through any method known in the art. As the filtration layer 25 is infused with the material, the increase to the diameter of the compliant screen 5 is negligible. General examples of the infusion material include elastomeric materials, plastic materials, silicon materials, rubber materials, the like, or any combinations of materials. Specific examples of the infusion material include, but are not limited to, hydrogenated nitrile butadiene rubber, a fluoro-rubber or a fluoroelastomer (e.g., all species of FKM's as defined by ASTM International standard D1418), a perfluoroelastomeric compound (e.g., all species of FFKM's as defined by ASTM standard 1418), any derivatives thereof, and any combination of infusion materials.

In some examples, friction-reducing coatings may be added to the filtration layer 25 of the compliant screen 5. The friction-reducing coatings may decrease resistance to movement of the filtration layer 25 when the activation chambers 15 are expanded. Examples of the friction-reducing coatings may include, but are not limited to, polytetrafluoroethylene, molybdenum disulfide, grease, lubricants, graphite, and any combination of friction-reducing coatings.

The outermost layer of the compliant screen 5 is the outer shroud 30. The outer shroud 30 shields the inner components of the compliant screen 5 and may be made from a material configured for expansion, yet also resilient to potential abrasion from contact with the wellbore walls, the formation, or other wellbore equipment. Generally, the outer shroud 30 contains openings, of a desired size and shape to allow for expansion as well as the inflow of formation fluids. In some optional examples, the openings of the outer shroud 30 are infused with a material that reduces flow through the openings of the outer shroud 30. This material may be swellable or non-swellable. This material may be the same type of materials used for infusion of the filtration layer 25. In individual examples, the material used for infusion of the openings of the outer shroud 30 may be the same species or a different species than the material chosen for infusion of the filtration layer 25. Additionally, the outer shroud 30 may also be divided into a lower transition portion, a compliant portion, and an upper transition portion with the lower and upper transition portions infused with the material analogously to the above-described filtration layer 25. In these optional examples, the infused outer shroud 30 may provide an additional layer that reduces cross flow of the compliant screen 5 while not reducing inflow of wellbore fluids from the adjacent subterranean formation.

It should be clearly understood that the example system illustrated by FIG. 1 is merely a general application of the principles of this disclosure in practice, and a wide variety of other examples are possible. Therefore, the scope of this disclosure is not limited in any manner to the details of FIG. 1 as described herein.

Figure 2:
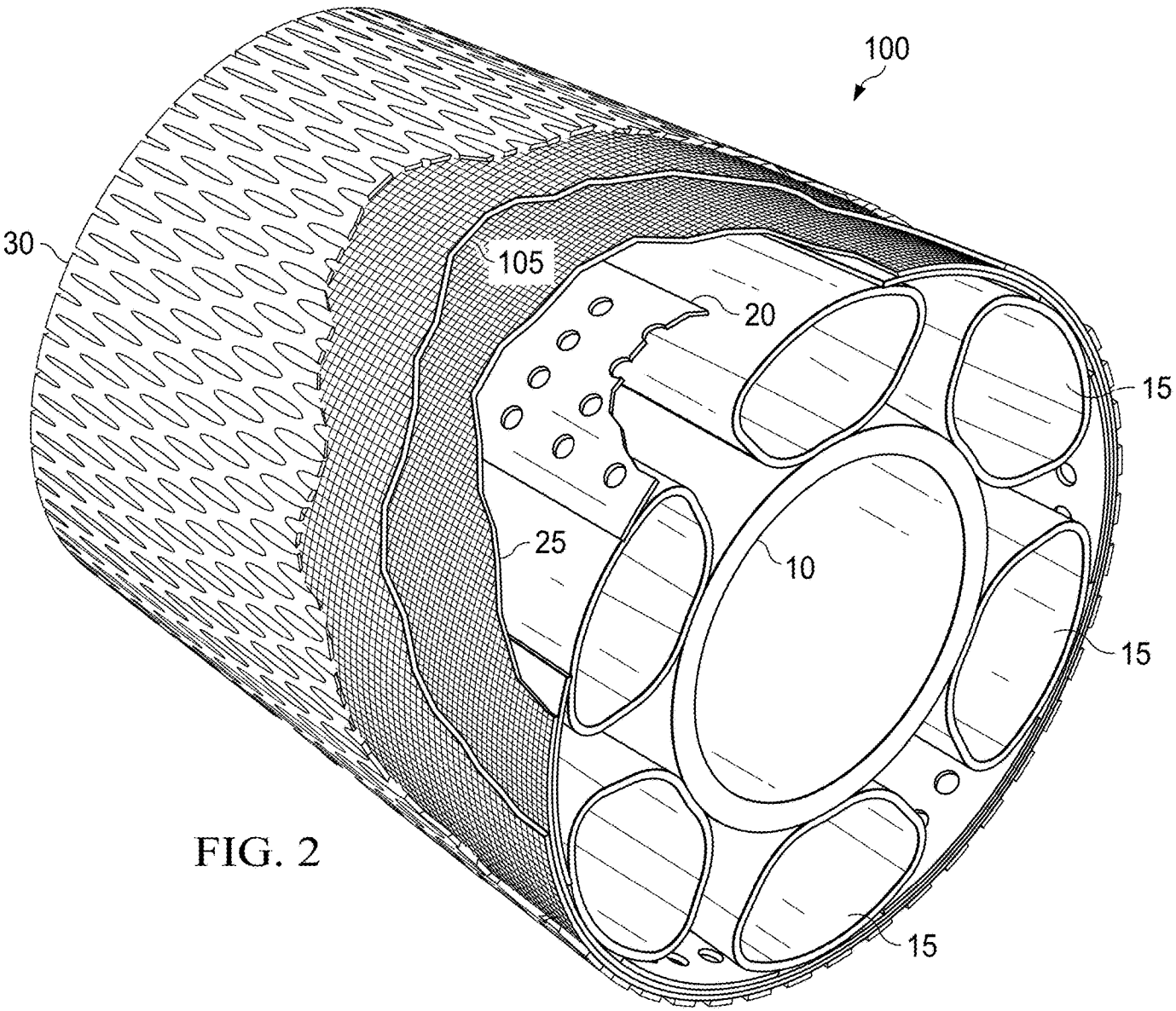
FIG. 2 is a perspective cross-section of another example compliant screen in accordance with one or more examples described herein.

FIG. 2 is a perspective cross-section of an example compliant screen 100. In the example of FIG. 2, components labeled with the same reference numbers as FIG. 1 are the same components as illustrated in FIG. 1. The compliant screen 100 has been deployed on a wellbore conduit 10 and may be introduced into the wellbore by being run in hole on the wellbore conduit 10. The compliant screen 100 comprises a plurality of activation chambers 15, a drainage layer 20, a filtration layer 25, an outer shroud 30, and at least two flow-reducing layers 105.

The flow-reducing layers 105 are disposed over the lower and upper transition portions of the filtration layer 25. The compliant portion of the filtration layer 20 does not have a flow-reducing layer 105 disposed over it. Each of the flow-reducing layers 105 comprises a thin sheet of a durable material, such as a metal, that has a material pressure molded on top of it to cover the sheets completely or only in desired areas. In some alternative examples, the material may be affixed to the sheets by a chemical reaction, bonding with a bonding agent, or through other mechanical mechanisms such as threaded connections, clamping, swaging, and the like. The flow-reducing layers 105 reduce fluid flow out of the compliant screen 100 at the areas of the upper and lower transition portions of the filtration layer 25 while inflow through the compliant portion of the filtration layer 25 is not impacted.

The material pressure molded on top of the thin sheets of the flow-reducing layers 105 may be a swellable or non-swellable material. This material may form a complete or partial seal with adjacent surfaces to reduce flow through at least a portion of the upper and lower transition portions of the filtration layer 25 and consequently through the compliant screen 5. Flow through the compliant portion of the filtration layer 25 is not reduced.

The material may be a non-swellable material that will not swell from contact with formation and wellbore fluids. Alternatively, this material may be a swellable material. As the flow-reducing layers 105 are relatively thin, the increase to the diameter of the compliant screen 5 is negligible. General examples of the material include elastomeric materials, plastic materials, silicon materials, rubber materials, the like, or any combinations of materials. Specific examples of the material include, but are not limited to, hydrogenated nitrile butadiene rubber, a fluoro-rubber or a fluoroelastomer (e.g., all species of FKM's as defined by ASTM International standard D1418), a perfluoroelastomeric compound (e.g., all species of FFKM's as defined by ASTM standard 1418), any derivatives thereof, and any combination of infusion materials.

The example of FIG. 2 utilizes the filtration layer 25 as described in FIG. 1. Optionally, an unmodified filtration layer which does not comprise an infused material in the upper and lower transition portions may be used in place of filtration layer 25. Additionally, a modified or unmodified outer shroud 30 may be used as described in FIG. 1.

It should be clearly understood that the example system illustrated by FIG. 2 is merely a general application of the principles of this disclosure in practice, and a wide variety of other examples are possible. Therefore, the scope of this disclosure is not limited in any manner to the details of FIG. 2 as described herein.

Figure 3:
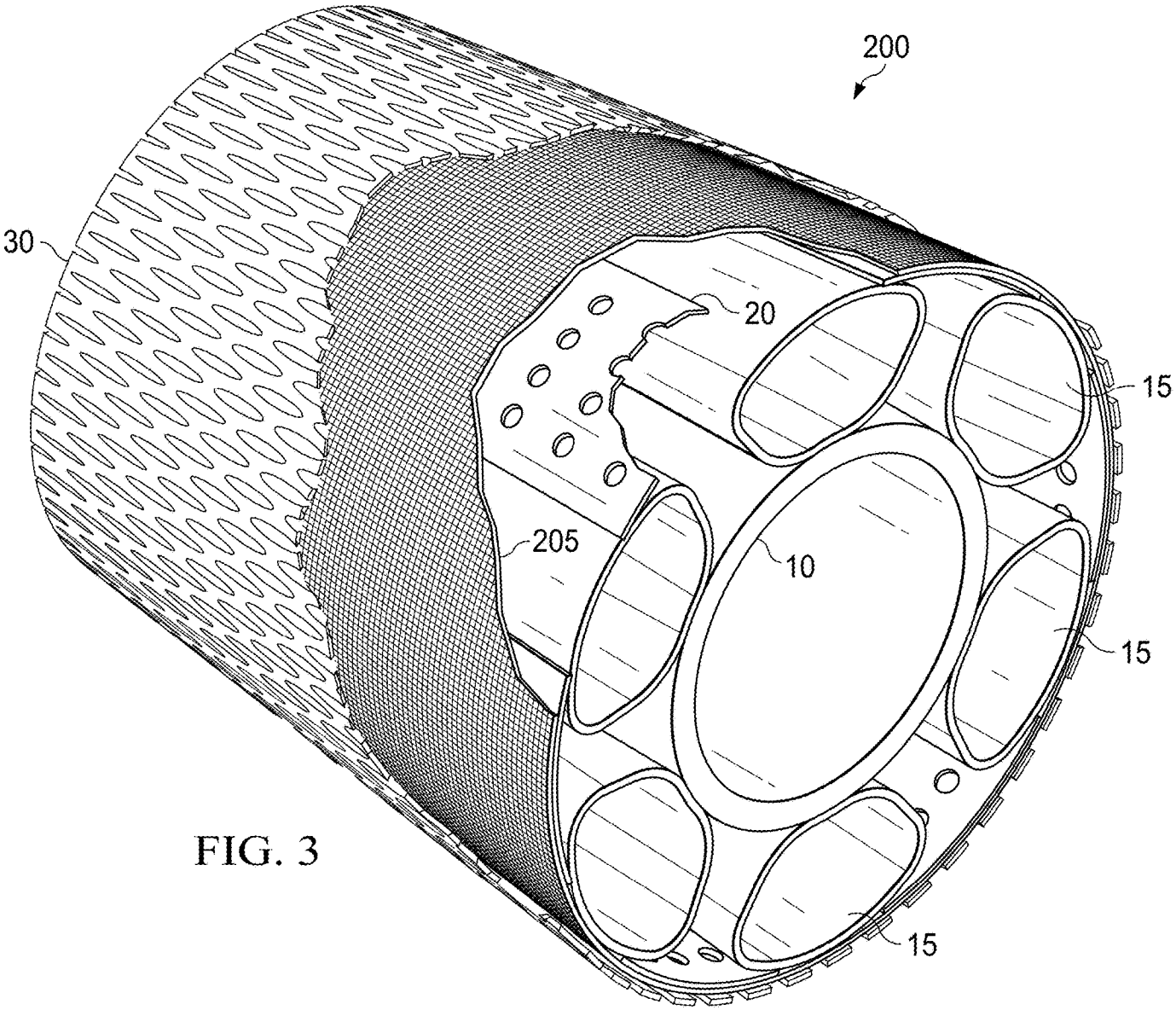
FIG. 3 is a perspective cross-section of an additional example compliant screen in accordance with one or more examples described herein.

FIG. 3 is a perspective cross-section of an example compliant screen 200. In the example of FIG. 3, components labeled with the same reference numbers as FIG. 1 are the same components as illustrated in FIG. 1. The compliant screen 200 has been deployed on a wellbore conduit 10 and may be introduced into the wellbore by being run in hole on the wellbore conduit 10. The compliant screen 200 comprises a plurality of activation chambers 15, a drainage layer 20, a filtration layer 205, and an outer shroud 30.

The filtration layer 205 is generally a mesh that is used to filter the formation particulates from the influent wellbore fluid to screen out the formation particulates from entering the wellbore conduit 10. The filtration layer 205 may comprise a single overlapping layer or multiple interwoven overlapping layers of filtration material that move over each other during the activation/expansion of the compliant screen 200. The filtration layer 205 comprises three portions distributed along the length of the filtration layer 205 in the axial direction. As will be illustrated below, the first portion of the filtration layer 205 is a lower transition portion. The lower transition portion is disposed downhole of the other two portions and comprises the lower terminal end of the filtration layer 205 and extends in the uphole direction for a desired length. Fluid flow through this lower transition portion is restricted. The second portion of the filtration layer 205 is the compliant portion, which is the middle portion of the filtration layer 205. The compliant portion is not restricted to fluid flow, and formation fluids may flow from the subterranean formation through the compliant portion and into the wellbore conduit 10. The third portion of the filtration layer 205 is an upper transition portion. The upper transition portion is disposed uphole of the other two portions and comprises the upper terminal end of the filtration layer 205 and extends in the downhole direction for a desired length. Fluid flow through this upper transition portion is restricted.

In the example of FIG. 3, the mesh of the filtration layer 25 comprises a weave of wires having gaps between the woven wires. The mesh of the lower and upper transition portions comprises a greater number of wires than the mesh of the compliant portion. Due to the increase in the number of wires, the mesh of the lower and upper transition portions is woven tighter than the mesh of the compliant portion thereby reducing the size of the gaps in the lower and upper transition portion. Fluid flow through the lower and upper portions is thus reduced relative to the compliant portion. The woven wires may be woven in any weave pattern Examples of specific weave patterns include, but are not limited to, plain weave, twilled weave, plain Dutch weave, twilled Dutch weave, reversed plain Dutch weave, reversed twilled Dutch weave, five-heddle weave, and any combination of weave patterns.

Optionally, the example of FIG. 3 may also comprise flow-reducing layers as described in FIG. 2. Additionally, a modified or unmodified outer shroud 30 may be used as described in FIG. 1.

It should be clearly understood that the example system illustrated by FIG. 3 is merely a general application of the principles of this disclosure in practice, and a wide variety of other examples are possible. Therefore, the scope of this disclosure is not limited in any manner to the details of FIG. 3 as described herein.

Figure 4:
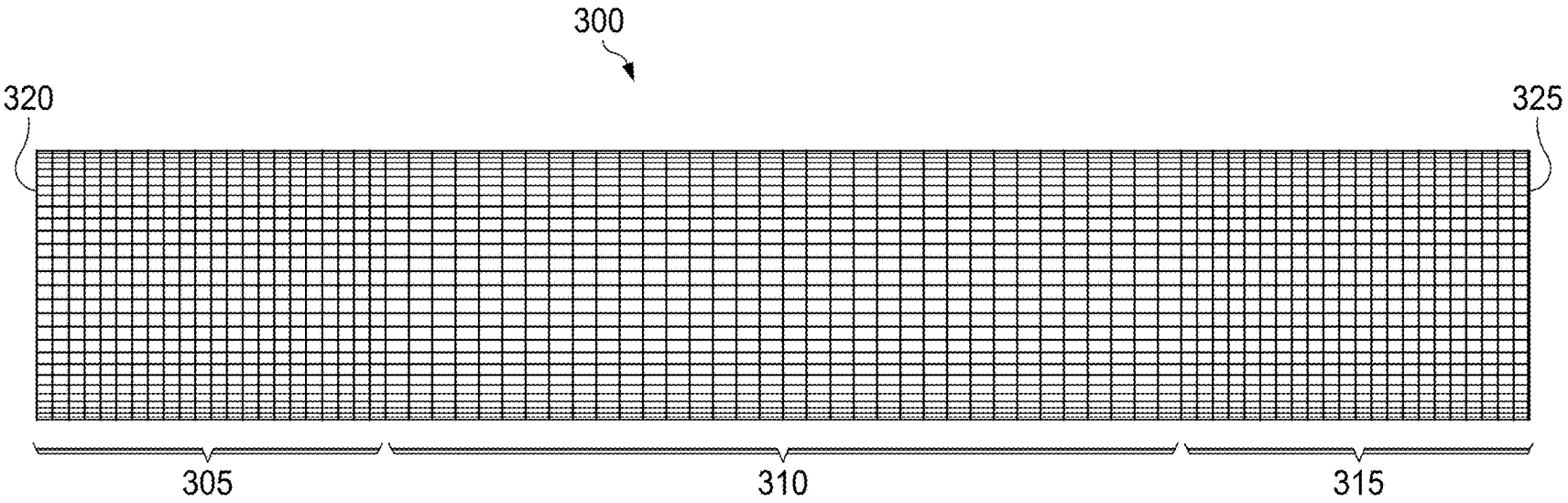
FIG. 4 is an illustration of the portioning of a filtration layer as described in the description of FIGS. 1, 2, and 3 in accordance with one or more examples described herein.

FIG. 4 is an illustration of the portioning of a filtration layer 300 as described above in the description of FIGS. 1, 2, and 3. The filtration layer 300 is portioned into three sections of varying lengths. The three portions are distributed along the length of the filtration layer 300 in the axial direction. The first portion of the filtration layer 300 is a lower transition portion 305 and this portion is disposed downhole of the other two portions and comprises the lower terminal end 320 of the filtration layer 300 and extends in the uphole direction for a desired length. Fluid flow through this lower transition portion 305 is restricted as described above in the examples of FIGS. 1, 2, and 3. The second portion of the filtration layer 300 is the compliant portion 310, which is the middle portion of the filtration layer 300 and is disposed between the lower transition portion 305 and the upper transition portion 315. The compliant portion 310 is not restricted to fluid flow and formation fluids may flow from the subterranean formation through the compliant portion 310 and into a wellbore conduit. The third portion of the filtration layer 300 is an upper transition portion 315 and this portion is disposed uphole of the other two portions and comprises the upper terminal end 325 of the filtration layer 300 and extends in the downhole direction for a desired length. Fluid flow through this upper transition portion is restricted as described above in the examples of FIGS. 1, 2, and 3. The lengths of the lower transition portion 305, the compliant portion 310, and the upper transition portion 315 may be varied as desired and may be adapted to the dimensions of the desired compliant screen and the wellbore.

It should be clearly understood that the example system illustrated by FIG. 4 is merely a general application of the principles of this disclosure in practice, and a wide variety of other examples are possible. Therefore, the scope of this disclosure is not limited in any manner to the details of FIG. 4 as described herein.

Figure 5:
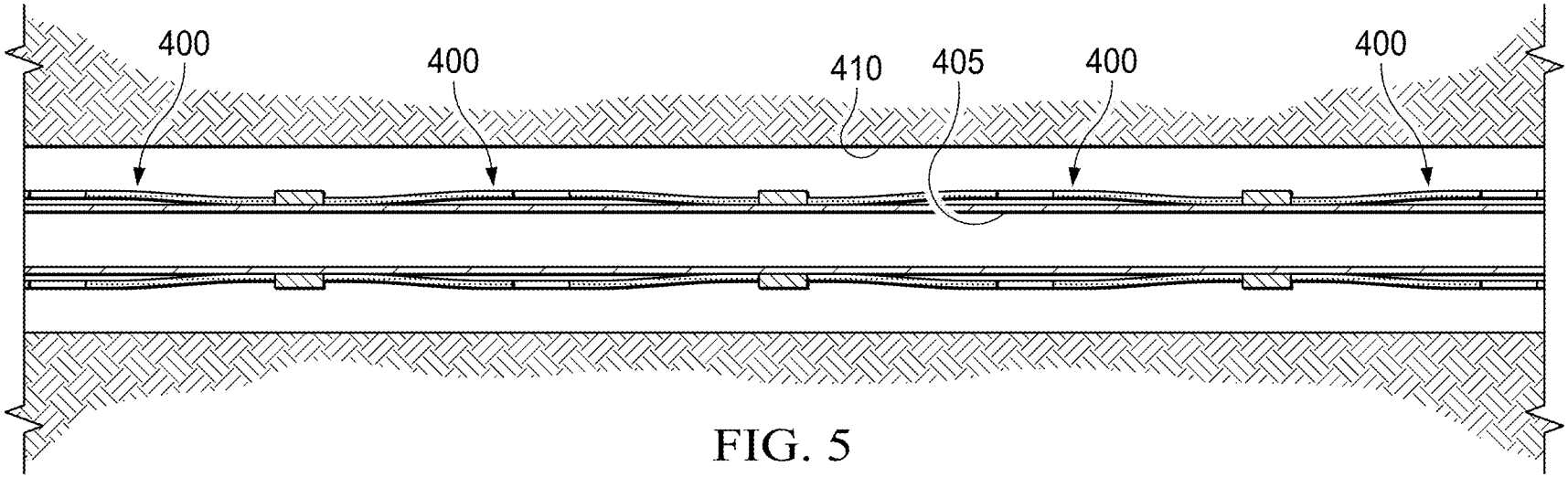
FIG. 5 is an illustration of a series of compliant screens as they are introduced into a wellbore on a wellbore conduit in accordance with one or more examples described herein.

FIG. 5 is an illustration of a series of compliant screens 400 as they are introduced into a wellbore 410 on a wellbore conduit 405. As the compliant screens 400 descend downhole, they are unactivated and the compliant screens have not been expanded.

Figure 6:
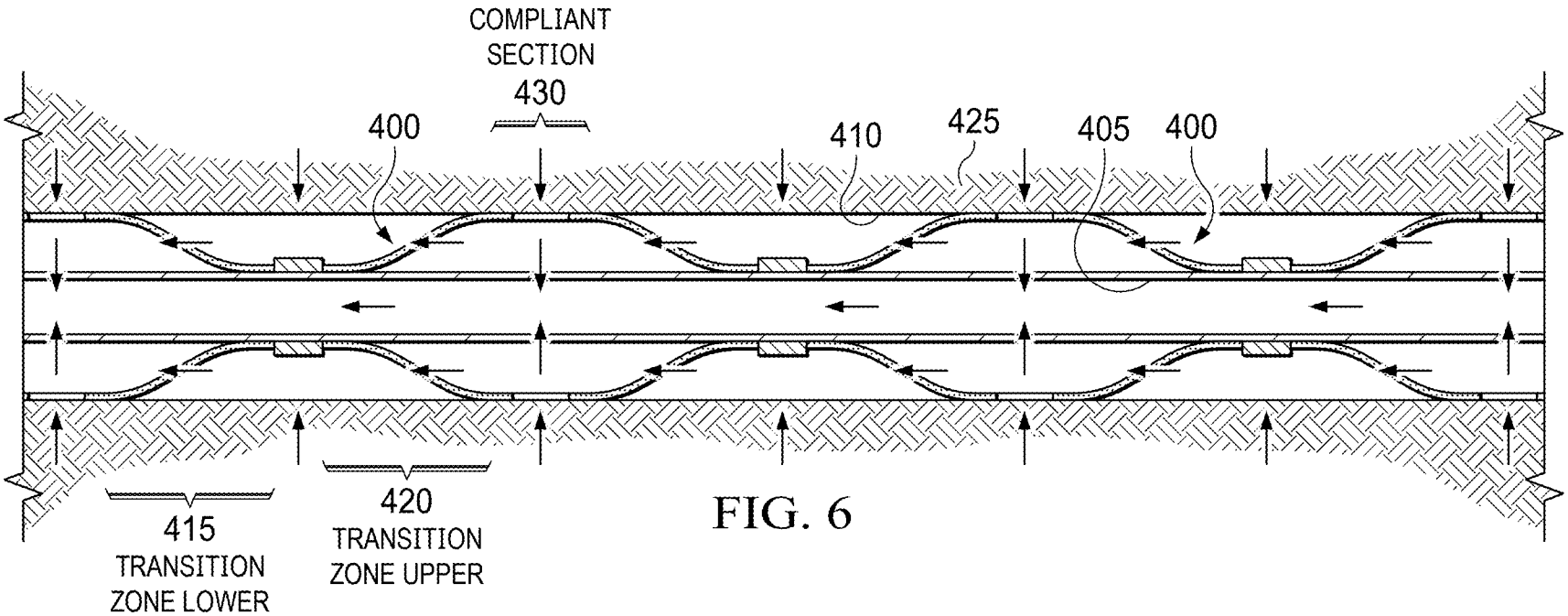
FIG. 6 is an illustration of a series of expanded compliant screens that lack flow restriction mechanisms in their lower and upper transition zones in accordance with one or more examples described herein.

FIG. 6 is an illustration of a series of compliant screens 400 that do not comprise flow restriction mechanisms and are subject to cross flow in the wellbore annulus. The compliant screens 400 have been activated by the expansion of the activation chambers, the introduction of expansion chemicals, through an expansion tool introduced through the interior of the wellbore conduit, etc. As the compliant screens 400 expand, they contact the adjacent subterranean formation 425. Each of these example compliant screens 400 do not possess any flow restriction mechanisms for their lower transition portions 415 and the upper transition portions 420. As illustrated by the arrows, fluid flows from the subterranean formation 425 into the compliant portion 430 of the compliant screens 400. Once within the compliant screens 400, a portion of the fluid enters the wellbore conduit 405 and another portion exits through the upper transition portion 420 into the wellbore annulus and then into a lower transition portion 415 of the adjacent uphole compliant screen 400. As there are no flow restriction mechanisms in the compliant screens 400, the formation fluids are free to cross flow from one compliant screen 400 to another through the wellbore annulus.

Figure 7:
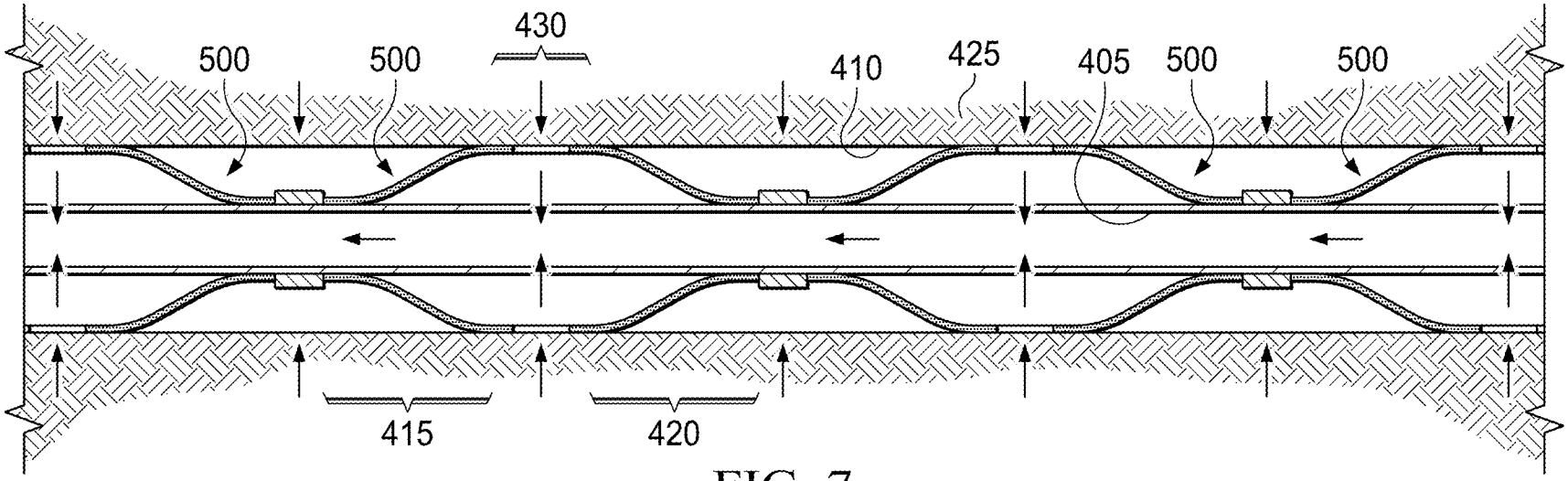
FIG. 7 is an illustration of a series of expanded compliant screens that have flow restriction mechanisms in their lower and upper transition zones in accordance with one or more examples described herein.

FIG. 7 is an illustration of a series of compliant screens 500 that have been activated by the expansion of the activation chambers, the introduction of expansion chemicals, through an expansion tool introduced through the interior of the wellbore conduit, etc. The compliant screens 500 differ from the compliant screens 400 of FIG. 6 in that the compliant screens 500 comprise flow restriction mechanisms in their lower transition portions 415 and their upper transition portions 420. As indicated by the arrows, formation fluids flow into compliant screens 500 via the compliant portion 430, which does not comprise a flow restriction mechanism as described herein. As cross flow through the lower transition portion 415 and the upper transition portion 420 is restricted, flow out of the compliant screens 400 into the wellbore annulus is reduced and a larger portion of the formation fluids are forced into the wellbore conduit 405 instead. In some examples, the flow restriction mechanisms may completely seal off the lower transition portions 415 and the upper transition portions 420 so that formation fluids do not flow out of the compliant screens 500 and there is no cross flow between compliant screens 500.

The compliant screens disclosed herein may directly or indirectly affect one or more components or pieces of equipment associated with or which may come into contact with the compliant screens such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided are compliant screen for a well completion in accordance with the disclosure and the illustrated FIGs. An example compliant screen comprises a drainage layer, a filtration layer disposed over the drainage layer, and an outer shroud disposed over the filtration layer. The filtration layer is a mesh having a lower transition portion, an upper transition portion, and a compliant portion disposed between the lower and upper transition portions. Flow through the lower and upper portions is reduced relative to the compliant portion.

Additionally or alternatively, the compliant screens may include one or more of the following features individually or in combination. The mesh of the filtration layer may comprise a weave of wires woven in in at least one weave pattern selected from the group consisting of plain weave, twilled weave, plain Dutch weave, twilled Dutch weave, reversed plain Dutch weave, reversed twilled Dutch weave, five-heddle weave, and any combination thereof. The mesh of the filtration layer may comprise a weave of wires having gaps between the woven wires; wherein the mesh of the lower and upper transition portions is infused with a material disposed in the gaps between the woven wires; wherein the material reduces or blocks flow through the gaps of the mesh of the lower and upper transition portions. The material may comprise an elastomer, a plastic, silicon, a rubber, or a combination thereof. The material may be coated with a friction-reducing coating. The friction-reducing coating may be selected from the group consisting of polytetrafluoroethylene, molybdenum disulfide, grease, lubricant, graphite, and any combination thereof. The material may be selected from the group consisting of hydrogenated nitrile butadiene rubber, a fluoro-rubber, a fluoroelastomer, a perfluoroelastomeric compound, any derivatives thereof, and any combination thereof. The compliant screen may further comprise two flow-reducing layers disposed over the filtration layer and under the outer shroud; wherein one flow-reducing layer is disposed over the lower transition portion of the filtration layer and the other flow-reducing layer is disposed over the upper transition portion of the filtration layer; wherein the flow-reducing layers comprise sheets of metal having a material disposed on them; wherein the flow-reducing layers reduce flow through the lower and upper transition portions. The material may comprise an elastomer, a plastic, silicon, a rubber, or a combination thereof. The mesh of the filtration layer may comprise a weave of wires having gaps between the woven wires; wherein the mesh of the lower and upper transition portions comprises a greater number of wires than the mesh of the compliant portion; wherein the mesh of the lower and upper transition portions is woven tighter than the mesh of the compliant portion to reduce the size of the gaps in the lower and upper transition portions thereby reducing flow through the lower and upper portions relative to the compliant portion. The outer shroud may comprises openings; wherein the openings of the outer shroud are infused with a material; wherein the material reduces flow through the openings of the outer shroud. The material may comprise an elastomer, a plastic, silicon, a rubber, or a combination thereof.

Provided are methods for preventing crossflow through a compliant screen in a well completion in accordance with the disclosure and the illustrated FIGs. An example method comprises providing a compliant screen comprising: a drainage layer, a filtration layer disposed over the drainage layer, and an outer shroud disposed over the filtration layer. The filtration layer is a mesh having a lower transition portion, an upper transition portion, and a compliant portion disposed between the lower and upper portions. Flow through the lower and upper portions is reduced relative to the compliant portion. The method further comprises activating the compliant screen by expanding the compliant screen such that it makes contact with an adjacent subterranean formation and flowing a fluid through the compliant section from the subterranean formation.

Additionally or alternatively, the method may include one or more of the following features individually or in combination. The mesh of the filtration layer may comprise a weave of wires woven in in at least one weave pattern selected from the group consisting of plain weave, twilled weave, plain Dutch weave, twilled Dutch weave, reversed plain Dutch weave, reversed twilled Dutch weave, five-heddle weave, and any combination thereof. The mesh of the filtration layer may comprise a weave of wires having gaps between the woven wires; wherein the mesh of the lower and upper transition portions is infused with a material disposed in the gaps between the woven wires; wherein the material reduces or blocks flow through the gaps of the mesh of the lower and upper transition portions. The material may comprise an elastomer, a plastic, silicon, a rubber, or a combination thereof. The material may be coated with a friction-reducing coating. The friction-reducing coating may be selected from the group consisting of polytetrafluoroethylene, molybdenum disulfide, grease, lubricant, graphite, and any combination thereof. The material may be selected from the group consisting of hydrogenated nitrile butadiene rubber, a fluoro-rubber, a fluoroelastomer, a perfluoroelastomeric compound, any derivatives thereof, and any combination thereof. The compliant screen may further comprise two flow-reducing layers disposed over the filtration layer and under the outer shroud; wherein one flow-reducing layer is disposed over the lower transition portion of the filtration layer and the other flow-reducing layer is disposed over the upper transition portion of the filtration layer; wherein the flow-reducing layers comprise sheets of metal having a material disposed on them; wherein the flow-reducing layers reduce flow through the lower and upper transition portions. The material may comprise an elastomer, a plastic, silicon, a rubber, or a combination thereof. The mesh of the filtration layer may comprise a weave of wires having gaps between the woven wires; wherein the mesh of the lower and upper transition portions comprises a greater number of wires than the mesh of the compliant portion; wherein the mesh of the lower and upper transition portions is woven tighter than the mesh of the compliant portion to reduce the size of the gaps in the lower and upper transition portions thereby reducing flow through the lower and upper portions relative to the compliant portion. The outer shroud may comprises openings; wherein the openings of the outer shroud are infused with a material; wherein the material reduces flow through the openings of the outer shroud. The material may comprise an elastomer, a plastic, silicon, a rubber, or a combination thereof.

Provided are systems for preventing crossflow through a compliant screen in a well completion in accordance with the disclosure and the illustrated FIGs. An example system comprises a compliant screen comprising a drainage layer, a filtration layer disposed over the drainage layer, and an outer shroud disposed over the filtration layer. The filtration layer is a mesh having a lower transition portion, an upper transition portion, and a compliant portion disposed between the lower and upper transition portions. Flow through the lower and upper portions is reduced relative to the compliant portion. The system further comprises a conduit having the compliant screen disposed thereon.

Additionally or alternatively, the system may include one or more of the following features individually or in combination. The mesh of the filtration layer may comprise a weave of wires woven in in at least one weave pattern selected from the group consisting of plain weave, twilled weave, plain Dutch weave, twilled Dutch weave, reversed plain Dutch weave, reversed twilled Dutch weave, five-heddle weave, and any combination thereof. The mesh of the filtration layer may comprise a weave of wires having gaps between the woven wires; wherein the mesh of the lower and upper transition portions is infused with a material disposed in the gaps between the woven wires; wherein the material reduces or blocks flow through the gaps of the mesh of the lower and upper transition portions. The material may comprise an elastomer, a plastic, silicon, a rubber, or a combination thereof. The material may be coated with a friction-reducing coating. The friction-reducing coating may be selected from the group consisting of polytetrafluoroethylene, molybdenum disulfide, grease, lubricant, graphite, and any combination thereof. The material may be selected from the group consisting of hydrogenated nitrile butadiene rubber, a fluoro-rubber, a fluoroelastomer, a perfluoroelastomeric compound, any derivatives thereof, and any combination thereof. The compliant screen may further comprise two flow-reducing layers disposed over the filtration layer and under the outer shroud; wherein one flow-reducing layer is disposed over the lower transition portion of the filtration layer and the other flow-reducing layer is disposed over the upper transition portion of the filtration layer; wherein the flow-reducing layers comprise sheets of metal having a material disposed on them; wherein the flow-reducing layers reduce flow through the lower and upper transition portions. The material may comprise an elastomer, a plastic, silicon, a rubber, or a combination thereof. The mesh of the filtration layer may comprise a weave of wires having gaps between the woven wires; wherein the mesh of the lower and upper transition portions comprises a greater number of wires than the mesh of the compliant portion; wherein the mesh of the lower and upper transition portions is woven tighter than the mesh of the compliant portion to reduce the size of the gaps in the lower and upper transition portions thereby reducing flow through the lower and upper portions relative to the compliant portion. The outer shroud may comprises openings; wherein the openings of the outer shroud are infused with a material; wherein the material reduces flow through the openings of the outer shroud. The material may comprise an elastomer, a plastic, silicon, a rubber, or a combination thereof.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A compliant screen for a well completion, the compliant screen comprises:

a drainage layer, a filtration layer disposed over the drainage layer; wherein the filtration layer is a mesh having a lower transition portion, an upper transition portion, and a compliant portion disposed between the lower and upper transition portions; wherein flow through the lower and upper transition portions is reduced relative to the compliant portion, wherein the mesh of the filtration layer comprises a weave of wires having gaps between the woven wires; wherein the mesh of the lower and upper transition portions is infused with a material disposed in the gaps between the woven wires; wherein the material reduces or blocks flow through the gaps of the mesh of the lower and upper transition portions, and an outer shroud disposed over the filtration layer.

2. The compliant screen of claim 1, wherein the mesh of the filtration layer comprises a weave of wires woven in in at least one weave pattern selected from the group consisting of plain weave, twilled weave, plain Dutch weave, twilled Dutch weave, reversed plain Dutch weave, reversed twilled Dutch weave, five-heddle weave, and any combination thereof.

3. The compliant screen of claim 1, further comprising two flow-reducing layers disposed over the filtration layer and under the outer shroud; wherein one flow-reducing layer is disposed over the lower transition portion of the filtration layer and the other flow-reducing layer is disposed over the upper transition portion of the filtration layer; wherein the flow-reducing layers comprise sheets of metal having a material disposed on them; wherein the flow-reducing layers reduce flow through the lower and upper transition portions.

4. The compliant screen of claim 3, wherein the material comprises an elastomer, a plastic, silicon, a rubber, or a combination thereof.

5. The compliant screen of claim 1, wherein the mesh of the filtration layer comprises a weave of wires having gaps between the woven wires; wherein the mesh of the lower and upper transition portions comprises a greater number of wires than the mesh of the compliant portion; wherein the mesh of the lower and upper transition portions is woven tighter than the mesh of the compliant portion to reduce the size of the gaps in the lower and upper transition portions thereby reducing flow through the lower and upper portions relative to the compliant portion.

6. The compliant screen of claim 1, wherein the outer shroud comprises openings; wherein the openings of the outer shroud are infused with a material; wherein the material reduces flow through the openings of the outer shroud.

7. The compliant screen of claim 6, wherein the material comprises an elastomer, a plastic, silicon, a rubber, or a combination thereof.

8. The compliant screen of claim 1, wherein the material comprises an elastomer, a plastic, silicon, a rubber, or a combination thereof.

9. The compliant screen of claim 8, wherein the material is coated with a friction-reducing coating.

10. The compliant screen of claim 9, wherein the friction-reducing coating is selected from the group consisting of polytetrafluoroethylene, molybdenum disulfide, grease, lubricant, graphite, and any combination thereof.

11. The compliant screen of claim 8, wherein the material is selected from the group consisting of hydrogenated nitrile butadiene rubber, a fluoro-rubber, a fluoroelastomer, a perfluoroelastomeric compound, any derivatives thereof, and any combination thereof.

12. A method for preventing crossflow through a compliant screen in a well completion, the method comprises:

providing the compliant screen comprising:

a drainage layer, a filtration layer disposed over the drainage layer; wherein the filtration layer is a mesh having a lower transition portion, an upper transition portion, and a compliant portion disposed between the lower and upper transition portions; wherein flow through the lower and upper transition portions is reduced relative to the compliant portion, wherein the mesh of the filtration layer comprises a weave of wires having gaps between the woven wires; wherein the mesh of the lower and upper transition portions is infused with a material disposed in the gaps between the woven wires; wherein the material reduces flow through the gaps of the mesh of the lower and upper transition portions, and an outer shroud disposed over the filtration layer;

activating the compliant screen by expanding the compliant screen such that it makes contact with an adjacent subterranean formation; and flowing a fluid through the compliant portion from the subterranean formation.

13. The method of claim 12, further comprising two flow-reducing layers disposed over the filtration layer and under the outer shroud; wherein one flow-reducing layer is disposed over the lower transition portion of the filtration layer and the other flow-reducing layer is disposed over the upper transition portion of the filtration layer; wherein the flow-reducing layers comprise sheets of metal having a material disposed on them; wherein the flow-reducing layers reduce flow through the lower and upper transition portions.

14. The method of claim 12, wherein the mesh of the filtration layer comprises a weave of wires having gaps between the woven wires; wherein the mesh of the lower and upper transition portions comprises a greater number of wires than the mesh of the compliant portion; wherein the mesh of the lower and upper transition portions is woven tighter than the mesh of the compliant portion to reduce the size of the gaps in the lower and upper transition portions thereby reducing flow through the lower and upper portions relative to the compliant portion.

15. A system for preventing crossflow through a compliant screen in a well completion, the system comprises:

the compliant screen comprising:

a drainage layer, a filtration layer disposed over the drainage layer; wherein the filtration layer is a mesh having a lower transition portion, an upper transition portion, and a compliant portion disposed between the lower and upper transition portions; wherein flow through the lower and upper transition portions is reduced relative to the compliant portion, wherein the mesh of the filtration layer comprises a weave of wires having gaps between the woven wires; wherein the mesh of the lower and upper transition portions is infused with a material disposed in the gaps between the woven wires; wherein the material reduces flow through the gaps of the mesh of the lower and upper transition portions, and an outer shroud disposed over the filtration layer; and a conduit having the compliant screen disposed thereon.

16. The system of claim 15, further comprising two flow-reducing layers disposed over the filtration layer and under the outer shroud; wherein one flow-reducing layer is disposed over the lower transition portion of the filtration layer and the other flow-reducing layer is disposed over the upper transition portion of the filtration layer; wherein the flow-reducing layers comprise sheets of metal having a material disposed on them; wherein the flow-reducing layers reduce flow through the lower and upper transition portions.

17. The system of claim 15, wherein the mesh of the filtration layer comprises a weave of wires having gaps between the woven wires; wherein the mesh of the lower and upper transition portions comprises a greater number of wires than the mesh of the compliant portion; wherein the mesh of the lower and upper transition portions is woven tighter than the mesh of the compliant portion to reduce the size of the gaps in the lower and upper transition portions thereby reducing flow through the lower and upper portions relative to the compliant portion.

18. The system of claim 15, wherein the material comprises an elastomer, a plastic, silicon, a rubber, or a combination thereof.

19. The system of claim 18, wherein the material is coated with a friction-reducing coating.

20. The system of claim 19, wherein the friction-reducing coating is selected from the group consisting of polytetrafluoroethylene, molybdenum disulfide, grease, lubricant, graphite, and any combination thereof.

* * * * *